US007243805B2

(12) United States Patent
Vodin

(10) Patent No.: US 7,243,805 B2
(45) Date of Patent: Jul. 17, 2007

(54) SYSTEM FOR SUPPORTING PICTURE FRAME MOULDING

(75) Inventor: George Vodin, 113 E. Main St., Barrington, IL (US) 60010

(73) Assignee: George Vodin, Barrington, IL (US)

( * ) Notice: Subject to any disclaimer, the term of this patent is extended or adjusted under 35 U.S.C. 154(b) by 111 days.

(21) Appl. No.: 10/774,703

(22) Filed: Feb. 2, 2004

(65) Prior Publication Data

US 2005/0167380 A1 Aug. 4, 2005

(51) Int. Cl.
*A47F 5/02* (2006.01)

(52) U.S. Cl. ..... 211/70; 211/78; 312/249.2; 312/305; 40/760

(58) Field of Classification Search ..... 211/70, 211/53, 163, 78, 81, 84, 85.2; 312/270.1, 312/270.2, 249.2, 305, 22, 9.6, 9.7; 40/722, 40/746, 760

See application file for complete search history.

(56) References Cited

U.S. PATENT DOCUMENTS 518,390 A * 4/1894 Bever ..... 312/135
3,868,157 A * 2/1975 Robinson ..... 312/305
4,490,932 A * 1/1985 McIntire ..... 40/473
4,850,658 A * 7/1989 Sandor ..... 312/225
5,297,685 A * 3/1994 Ramey ..... 211/59.4
5,392,902 A 2/1995 Vlastakis
5,494,347 A * 2/1996 Poortvliet et al. ..... 312/270.2
5,622,261 A 4/1997 Mobley et al.
5,899,343 A 5/1999 Franklin et al.
D418,330 S * 1/2000 Schumacher ..... D6/461
6,070,741 A * 6/2000 Bachman et al. ..... 211/13.1
6,321,475 B1 11/2001 Glanz
6,915,914 B2 * 7/2005 Farrand ..... 211/163

* cited by examiner

*Primary Examiner*—Richard E. Chilcot, Jr.
*Assistant Examiner*—Jared W. Newton
(74) *Attorney, Agent, or Firm*—Factor & Lake

(57) ABSTRACT

A display device for supporting a plurality of items such as frame molds comprising a frame housing having a plurality of internal open sections; a plurality of rotating panel members, each of which is situated within an internal section and each of which rotates relative to a central axis; and means for affixing frame molds to the rotating panel member.

5 Claims, 4 Drawing Sheets

Fig. 2b
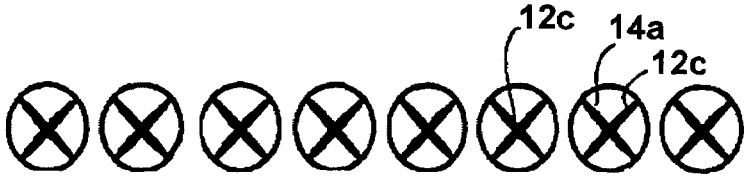
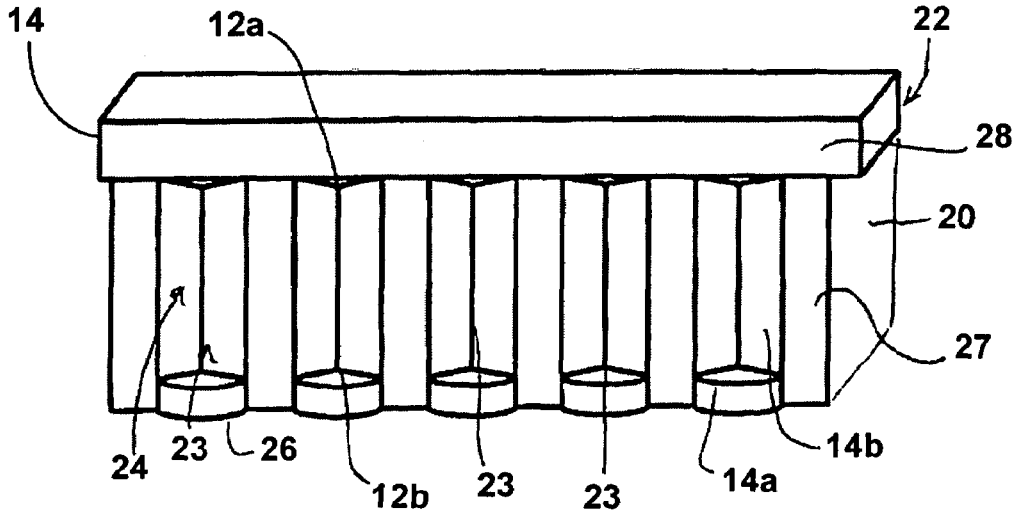
Fig. 2a

SYSTEM FOR SUPPORTING PICTURE FRAME MOULDING

FIELD OF THE INVENTION

The present invention is directed to a system for displaying frame moulding and the like. In particular, the present invention is directed to a system for displaying picture frame moulding and other similar items in a limited area of space.

BACKGROUND OF THE INVENTION

In the retail custom framing business it is imperative to have a wide selection of moulding samples and designs. A well-equipped frame shop or store may have between one and three thousand moulding samples in inventory to provide a selection for every taste and budget. The problem faced by such retailers is how to display frames and moulding adequately within a limited space.

Traditionally, most shops place samples on a wall. To do that requires either a very large space or a smaller more limited selection. An alternative to wall mounting is to use a spinner rack, which has several sides and can accommodate a higher density of samples with a small footprint. The problem with spinners is that several racks put together create a cluttered appearance and are difficult for the customer to focus on and make a choice.

Another solution has been to have a sliding wall, similar to a sliding door on a garage, barn or hangar. However, the problem with this type of system is that it is cumbersome, awkward and difficult to move.

There have been a large number of patents issued which are directed to various retail display systems for a wide litany of products. U.S. Pat. No. 6,321,475 to Glanz, for example, discloses a display device for mounting to the front edge of a store shelf providing a sealed environment for display of an object. Preferably, the object is in a constructed craft item which may be assembled from a kit which is offered for sale and is located on the store shelf adjacent the display device. The displayed object serves as a promotional vehicle for the kit. The display device includes a bracket for mounting the display device to the shelf and a product display case mounted to the bracket. The product display case includes a shelf construction upon which the constructed object can be displayed and a protective dome surrounding the shelf construction.

U.S. Pat. No. 5,899,343 to Franklin, et al, is directed to a stand-up, book-like jewelry display device that has a rectangular frame mounted upright on a horizontal bracket. Product panels that hold jewelry and graphics panels that depict the jewelry in use are rotatably mounted within the frame so that each panel swings about one of its edges, thereby giving the display the appearance of a book with pages to turn. Preferably, the product panels are alternated within the frame. In addition, the graphics panels are preferably narrower than the product panels such that, other than the graphics panel within the "leaf" being viewed, each graphics panel is obscured by the product panel above it so that it does not block from view any jewelry displayed on the product panel below it. In addition, the upright frame may be rotatably mounted to the horizontal bracket such that the frame can be rotated to allow the salesperson to change the displays without having to turn the bracket. The frame may be locked in place by a peg that extends downward through the bottom portion of one side of the frame into a recess in the bracket.

U.S. Pat. No. 5,392,902 to Vlastakis discloses a merchandise display device which includes a vertically disposed rear wall having opposing side edges that are attached to a pair of opposing, vertically disposed side wall assemblies. Each side wall assembly includes an inner panel facing the display section of the device, an outer panel foldably connected to the inner panel and a spacer panel interposed between substantial portions of the inner and outer panels. The inner panels of the side wall assemblies include vertically spaced, cooperating openings to accommodate shelf support members associated with shelves installed in the device. The shelves are inclined to promote gravity feed of product to the front edges of the shelves.

U.S. Pat. No. 5,622,261 to Mobley, et al., discloses a merchandising display device having an upright tubular housing and a removable decorative covering is disclosed. The housing has an open top for permitting access to merchandise contained in the housing. The covering is of a deflatably air-inflated sleeve structure and is disposed around the housing so as to cover the outside surface of the housing. The covering includes an outer wall which defines the outer perimeter of the sleeve structure. The covering is formed of air-impervious flexible sheet material such that the outer wall is bulged outwardly due to internal pressure of the covering to provide a contour different from the contour of the housing.

None of the patents of the prior art adequately maximize the display space and none are designed to cover an entire wall area. None of the patents identified disclose or suggest a system for maximizing space for frames, moulding and the like.

It would be desirable to provide a mechanism for displaying a multiplicity of frame molds in a compact and novel format.

It would be desirable to provide a display system which can support a substantial number of items such as frame molds in a rotatable and compact space.

These and other objects of the invention will become apparent from the summary and detailed description which follows.

SUMMARY OF THE INVENTION

In accordance with the present invention, a display device for supporting a plurality of items comprising a frame member having an internal section; and at least one rotating member comprising a rack which rotates via a central axis and which supports a plurality of display pieces.

In a further embodiment, the invention is a display device for supporting a plurality of items such as frame molds comprising: a frame housing having a plurality of internal open sections; a plurality of rotating panel members, each of which is situated within an internal section and each of which rotates relative to a central axis; and means for affixing frame molds to the rotating panel member.

In a further embodiment, the invention is a display device for supporting a plurality of items such as frame molds comprising a frame housing having a plurality of internal open sections; a plurality of rotating panel members have an "x-shape," each of which is situated within an internal section and each of which rotates relative to a central axis; means for affixing frame molds to the rotating panel member; and at least one additional wall surface proximate to the rotating panel member for the placement of molds.

The present invention is more fully described below.

BRIEF DESCRIPTION OF THE FIGURES

FIGS. 2*a* through 2*d* are side and top views of alternative embodiments of the present invention.

DETAILED DESCRIPTION OF THE INVENTION

The present invention is directed to a modular storage system for handling and holding frame moulding and other display items. While the present invention is being described in the context of a device or system for holding frame moulding, it is to be appreciated that the teachings of the present invention are applicable to the display of a wide variety of products which need to be displayed in a compact area and space maximizing system.

Figure 1:
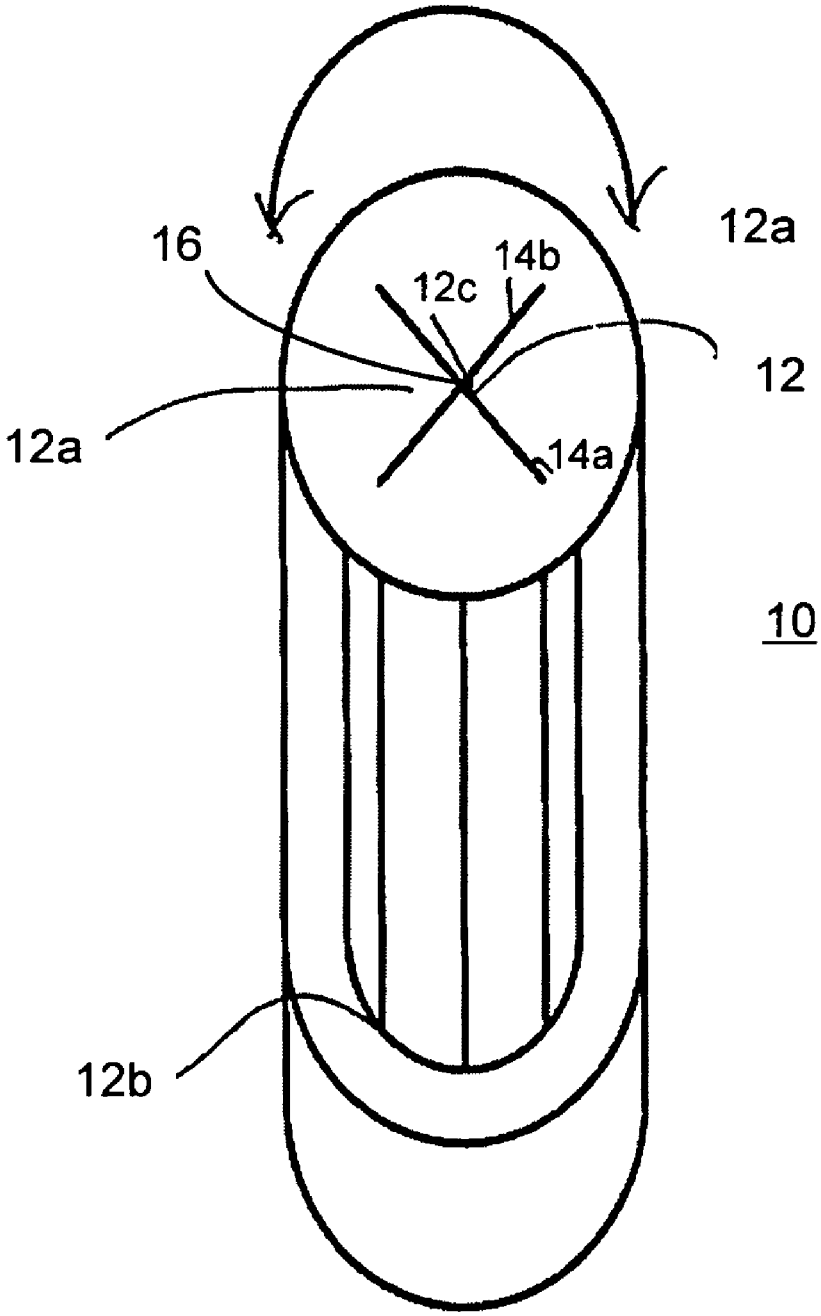
FIG. 1 is a side perspective view of the wall moulding system of the present invention.
Figure 2D:
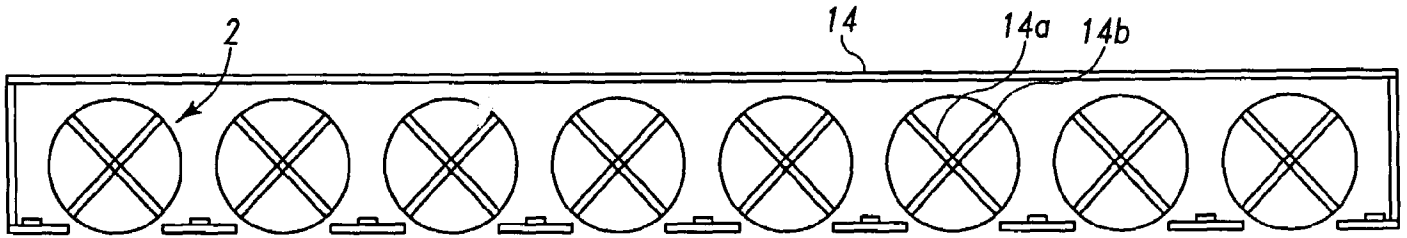
Figure 2C:
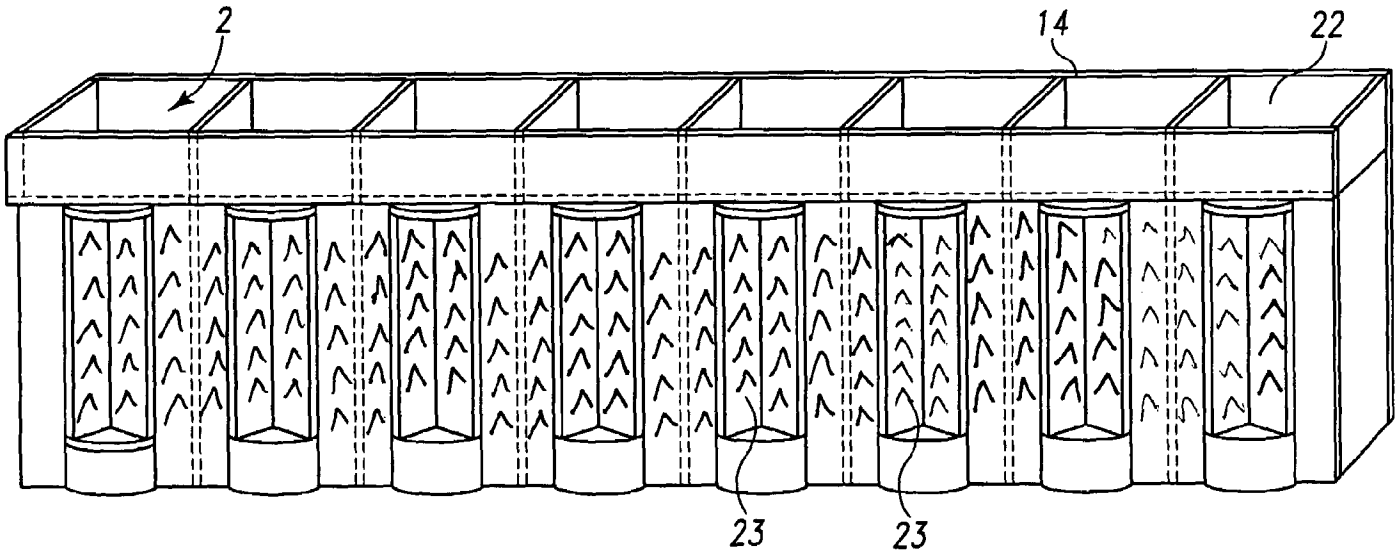
Figure 3:
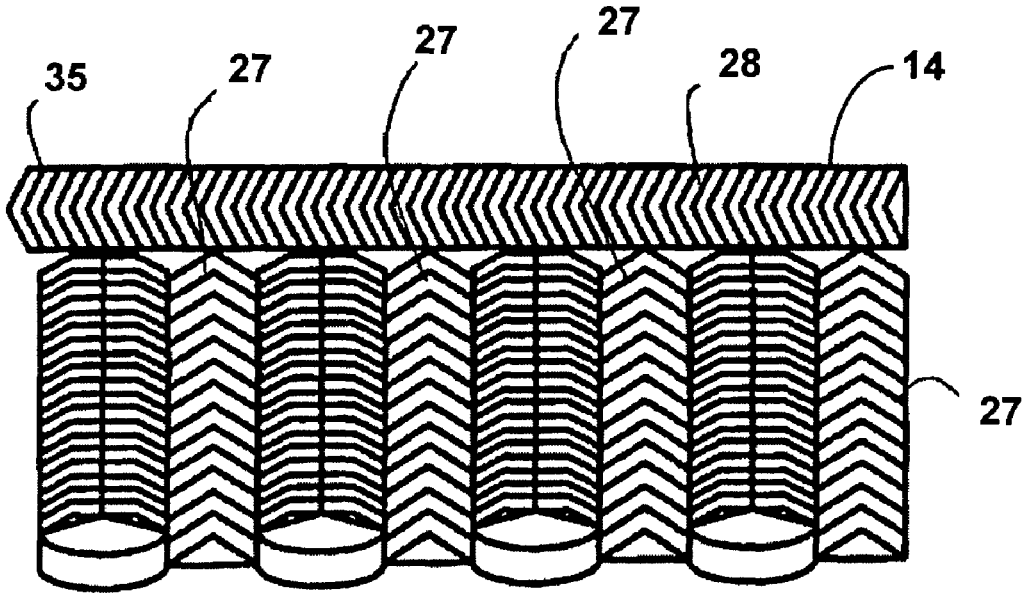
FIG. 3 is an isolated view of the wall moulding display system of the present invention.

Referring to FIGS. 1 to 3, in a most preferred embodiment, the invention comprises at least one rotational display system 10 which comprises a spinning rack 12 which is situated within a frame or housing 14. As shown in FIGS. 2*a*-2*d* and most specifically the top views of FIGS. 2*b* and 2*d*, the spinning rack 12 in one embodiment is "x-shaped" and comprises two cross members 14*a* and 14*b* which rotate at the intersection 16 of the "x."

As shown in the Figures, the spinning rack 12, in one embodiment, stands vertically and is rotationally supported at its upper and lower ends 12*a*, 12*b* at central axes 12*c*. Each "x-shaped" rack thus presents four walls with eight surfaces on which products or items such as moulding can be placed.

In operation, as shown in FIGS. 1 and 2*a*-2*d*, the end user can rotate the rack in respect to its control axis 12*c* and be presented with a plurality of surfaces (eight). Each spinning rack thus comprises a rotating system of four panels, having two sides. It is to be appreciated that, while the present invention is being described in the context of and "x-shaped" rack with four walls, alternative embodiments 6, 8, 12 or more are suggested by the invention.

Referrings to FIGS. 2*a*-2*d*, the present invention is shown in the context of a plurality of racks with a housing 20. The system comprises a rectangular frame 22 which supports a plurality of vertical openings 23. Each opening includes a vertical space 2 in which a rotating spinning rack display member 12 can be inserted and rotated. Thus, each individual panel unit includes a rotational multi-surfaced device for the placement of moulding or other display items.

In the more preferred embodiment as shown in FIGS. 2*a*-2*d* and 3, the invention comprises a series of two or more eight panel racks arranged in tandem and equidistant from one another. Retail merchants and the like can therefore place two or more units next to each other so as to cover a large surface or an entire wall. The unit in this configuration is designed to hold a larger number of moulding samples. These would be displayed in vertical panels 27, dividing each spinning rack as well as the area 28 above the racks. Hence, molding samples would be disclosed on each of the eight surfaces of the spinning rack and in areas 27, 28.

As shown in FIG. 3, a plurality of the modular units create an illusion of one solid wall of frame moulding corner samples. The chevron shapes 35 represent moulding pieces. This system not only provides a neater, more organized appearance, but also allows the customer to focus and to more readily make a choice, since they can only see the columns of samples that are immediately in front of them, they are not overwhelmed. This system makes it easy for the customer to spin the racks to see the full spectrum of choices, and in bits that they can assimilate easily. The attachment means comprises a hook and loop to be easy detached. VELCRO can be used as a hook and loop fastener. The critical point is that the moulding samples have to be secured and unsecured easily and quickly.

The present invention has been described in the context of the above-discussed preferred embodiment. It is to be appreciated that other embodiments fulfill the spirit and scope of the present invention and that the true nature and scope of the present invention is to be determined with reference to the claims appended hereto.

The invention claimed is:

1. A display device for supporting picture frame pieces, said device comprising:

a frame member having an internal section and a front face comprising at least three vertical panels lying within a front plane and spaced apart from each other to form a plurality of gaps therebetween, wherein a first plurality of picture frame pieces are removably attached to said vertical panels via fasteners;

at least two rotating members mounted to the frame member and each rotating member comprising an X-shaped cross-section and four continuous even surfaced panels that rotate via a central axis, wherein a second plurality of picture frame pieces are removably attached to said rotating members via fasteners; and, wherein the central axis of said at least two rotating members lies within a back plane and each of said plurality of gaps in said front face is occupied by one of said rotating members that can be rotated to a position to form a substantially contiguous wall with said front face.

2. The device of claim 1 wherein the picture frame pieces are supported by hook and loop fasteners.

3. The display device of claim 1 further comprising at least three of the rotating members in tandem and equidistantly spaced apart from one another.

4. The display device of claim 1, wherein one of the rotating members is equidistantly spaced between two other of the rotating members.

5. The display device of claim 1, wherein the front plane is parallel to the back plane.

* * * * *